US006089699A

United States Patent [19]

Minemoto et al.

[11] Patent Number: 6,089,699

[45] Date of Patent: Jul. 18, 2000

[54] METHOD AND APPARATUS FOR CONTROLLING INKJET EJECTION ELECTRODES BY VARYING THE ELECTRODES POTENTIALS

[75] Inventors: Hitoshi Minemoto; Yoshihiro Hagiwara; Junichi Suetsugu; Ryosuke Uematsu; Tadashi Mizoguchi; Hitoshi Takemoto; Kazuo Shima; Toru Yakushiji, all of Niigata, Japan

[73] Assignee: NEC Corporation, Tokyo, Japan

[21] Appl. No.: 08/868,425

[22] Filed: Jun. 3, 1997

[30] Foreign Application Priority Data

Jun. 3, 1996 [JP] Japan ..... 8-140525
Jul. 31, 1996 [JP] Japan ..... 8-202365

[51] Int. Cl.[7] ..... B41J 2/06

[52] U.S. Cl. ..... 347/55

[58] Field of Search ..... 347/55, 120, 123, 347/111, 159, 141, 17, 103, 154; 399/271, 290, 292, 293, 294, 295

[56] References Cited

U.S. PATENT DOCUMENTS 4,266,232 5/1981 Juliana, Jr. et al. ..... 346/140
4,710,784 12/1987 Nakayama ..... 346/140
5,742,412 4/1998 Minemoto et al. ..... 347/55

FOREIGN PATENT DOCUMENTS 627313 12/1994 European Pat. Off. .
650836 5/1995 European Pat. Off. .
778134 6/1997 European Pat. Off. .
60-228162 11/1985 Japan .
93 11866 6/1993 WIPO .

*Primary Examiner*—John Barlow
*Assistant Examiner*—Raquel Yvette Gordon
*Attorney, Agent, or Firm*—Ostrolenk, Faber, Gerb & Soffen, LLP

[57] ABSTRACT

In an electrostatic inkjet device having a plurality of ejection electrodes, when an ejection electrode is designated as an ejection dot, a potential of the ejection electrode is changed to an ejection level for a first time period. When the ejection electrode is not designated as an ejection dot, the potential of the ejection electrode is changed within a predetermined level different from a ground level such that ejection does not occur at the ejection electrode.

35 Claims, 13 Drawing Sheets

METHOD AND APPARATUS FOR CONTROLLING INKJET EJECTION ELECTRODES BY VARYING THE ELECTRODES POTENTIALS

BACKGROUND OF THE INVENTION

1. Field of the Invention

The present invention relates to an apparatus employing an inkjet recording method, and more particularly to a method and apparatus which controls ejection electrodes for ejecting particulate matter such as pigment matter and toner matter by making use of an electric field.

2. Description of the Related Art

There has recently been a growing interest in non-impact recording methods, because noise while recording is extremely small to such a degree that it can be neglected. Particularly, inkjet recording methods are extremely effective in that they are structurally simple and that they can perform high-speed recording directly onto ordinary medium. As one of the inkjet recording methods, there is an electrostatic inkjet recording method.

The electrostatic inkjet recording apparatus generally has an electrostatic inkjet recording head and a counter electrode which is disposed behind the recording medium to form an electric field between it and the recording head. The electrostatic inkjet recording head has an ink chamber which temporarily stores ink containing toner particles and a plurality of ejection electrodes formed near the end of the ink chamber and directed toward the counter electrode. The ink near the front end of the ejection electrode forms a concave meniscus due to its surface tension, and consequently, the ink is supplied to the front end of the ejection electrode. If positive voltage relative to the counter electrode is supplied to a certain ejection electrode of the head, then the particulate matter in ink will be moved toward the front end of that ejection electrode by the electric field generated between the ejection electrode and the counter electrode. When the coulomb force due to the electric field between the ejection electrode and the counter electrode considerably exceeds the surface tension of the ink liquid, the particulate matter reaching the front end of the ejection electrode is jetted toward the counter electrode as an agglomeration of particulate matter having a small quantity of liquid, and consequently, the jetted agglomeration adheres to the surface of the recording medium. Thus, by applying pulses of positive voltage to a desired ejection electrode, agglomerations of particulate matter are jetted in sequence from the front end of the ejection electrode, and printing is performed. A recording head such as this is disclosed, for example, in Japan Laid-Open Patent Publication No. 60-228162 and PCT International Publication No. WO93/11866.

Particularly, in the Publication (60-228162), there is disclosed an electrostatic inkjet printer head where a plurality of ejection electrodes are disposed in an ink nozzle, and the front end of each ejection electrode is formed on the projecting portion of a head base which projects from the ink nozzle. The front end of this projecting portion has a pointed configuration, and the ejection electrode is formed in accordance with the direction of the pointed end. An ink meniscus is formed near the front end of the ejection electrode.

In the conventional electrostatic inkjet device as mentioned above, when voltage pulses are consecutively applied to an ejection electrode in relatively short intervals, the particulate matter is supplied to the front end of the ejection electrode and then is jetted toward the counter electrode.

However, in cases where the time interval between voltage pulses is long, the particulate matter withdraws from the front end of the ejection electrode because of reduced electrostatic force during the interval. In such a state, when the voltage pulse is applied, the particulate matter cannot be instantly jetted. Therefore, no ink may be jetted by that ejection electrode, resulting in deteriorated quality of printing.

Further, in the conventional electrostatic inkjet device, an ejection electrode which is not driven is grounded. Therefore, when an ejection electrode is driven and the adjacent ejection electrodes are not driven, an electric field is generated between the driven ejection electrode and the adjacent ejection electrodes. The electric field generated between them causes the particulate matter in the ink to drift away from the driven ejection electrode, resulting in deteriorated quality of printing.

SUMMARY OF THE INVENTION

It is an objective of the present invention to provide a method and an apparatus which controls ejection electrodes of a inkjet device to eject ink therefrom with reliability and stability.

Another objective of the present invention is to provide a method and an apparatus which are capable of stably ejecting ink from a plurality of ejection electrodes.

According to the present invention, a potential of an ejection electrode is changed to an ejection level for a first time period when the ejection electrode is designated as an ejection dot, and the potential of the ejection electrode is changed within a predetermined level different from a ground level such that ejection does not occur at the ejection electrode when the ejection electrode is not designated as an ejection dot. In other words, a potential controller is provided to change the potential of the ejection electrode such that ejection does not occur at the ejection electrode when the ejection electrode is not designated as an ejection dot.

When the ejection electrode is not designated as an ejection dot, the potential of the ejection electrode is not set to the ground level but is changed within the a predetermined level different from a ground level such that ejection does not occur at the ejection electrode. Therefore, when the ejection potential is applied to the ejection electrode, ejection can instantly occur at the ejection electrode. Further, when an ejection electrode is driven and the adjacent ejection electrodes are not driven, the potentials of the adjacent ejection electrodes can be changed so as to reduce the potential difference between the driven ejection electrode and the adjacent ejection electrodes Therefore, the drift of particulate matter included in the ink can be prevented.

BRIEF DESCRIPTION OF THE DRAWINGS

The above and other objects and advantages will become apparent from the following detailed description when read in conjunction with the accompanying drawings wherein.

DETAILED DESCRIPTION OF THE PREFERRED EMBODIMENTS

Figure 1:
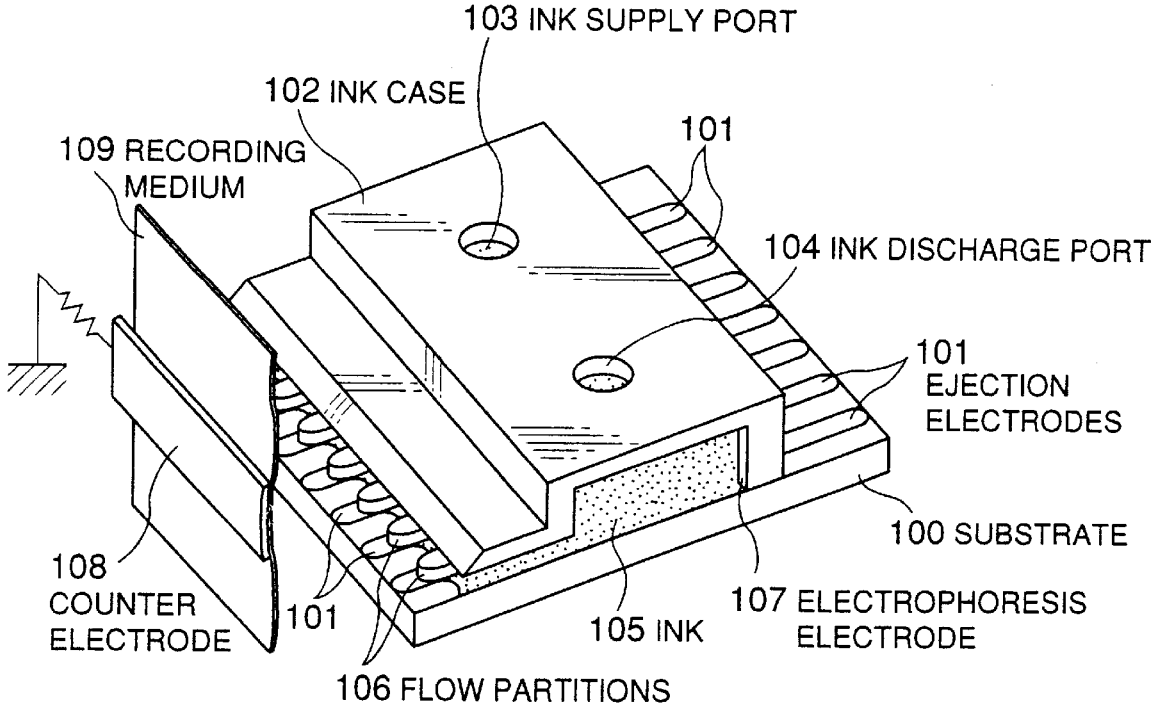
FIG. 1 is a part-fragmentary perspective view showing the printing portion of an electrostatic inkjet recording apparatus used for the present invention.

Referring to FIG. 1, there is shown an electrostatic inkjet recording head to which the present invention can be applied. A substrate 100 is made of an insulator such as plastic and has a plurality of ejection electrodes 101 formed thereon in accordance with a predetermined pattern. An ink case 102 made of an insulating material is mounted on the substrate 100. The ink case 102 is formed with an ink supply port 103 and an ink discharge port 104. The space, defined by the substrate 100 and the ink case 102, constitutes an ink chamber which is filled with ink 105 containing toner particles which is supplied through the ink supply port 103. The front end of the ink case 102 is formed with a cutout to form a slit-shaped ink nozzle with flow partitions 106 between the ink case 102 and the substrate 100. The ejection portions of the ejection electrodes 101 are disposed in the ink nozzle.

At the inner rear end of the ink case 102, an electrophoresis electrode 107 is provided in contact with the ink 105 within the ink chamber. If voltage with the same polarity as toner particles is applied to the electrophoresis electrode 107, then an electric field will arise between the electrode 106 and a counter electrode 108 which is grounded through a resistor, causing toner particles to be moved toward the front end of the ejection electrodes 101 due to the electrophoresis phenomenon. In this state, when a pulse voltage is applied to an ejection electrode for ink ejection, the particulate matter is jetted from the front end of that ejection electrode to a recording medium 109.

Figure 2:
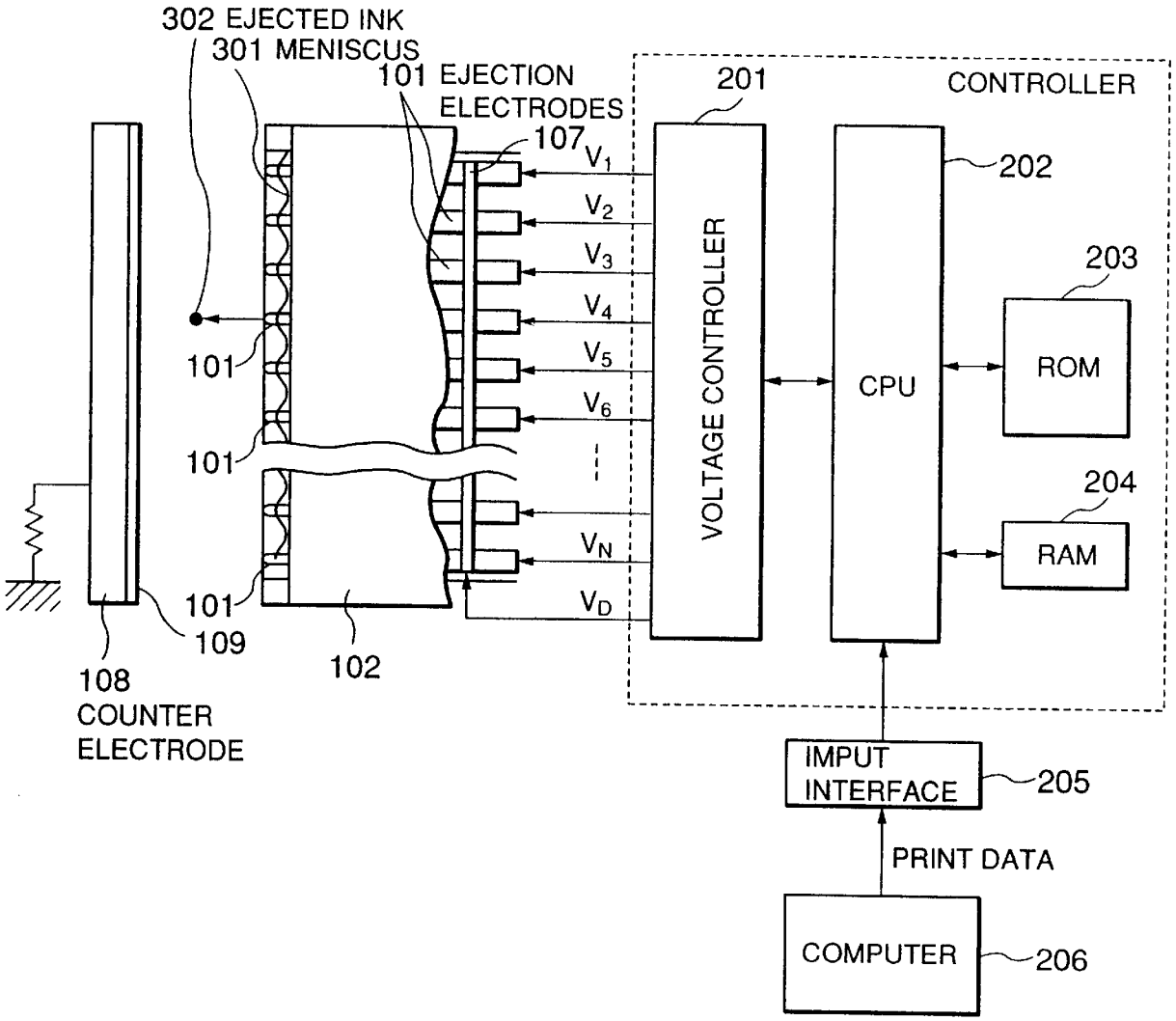
FIG. 2 is a block diagram showing a schematic circuit configuration which drives the electrostatic inkjet recording head according to the present invention.

Referring to FIG. 2, where elements of the inkjet device similar to those previously described with reference to FIG. 1 are denoted by the same reference numerals, a voltage controller 201 generates control voltages $V_1$–$V_N$ under the control of a processor (CPU) 202 and outputs them to the ejection electrodes 101, respectively. Each of the control voltages $V_1$–$V_N$ is set to a controlled voltage which is, for example, one of non-ejection voltage $V_{OC}$, an ejection voltage $V_P$ and a ground voltage under the control of the processor 202.

The processor 202 performs the drive control of the inkjet device according to a control program stored in a read-only memory 203 and controls the voltage controller 201 depending on print data received from a computer 206 through an input interface 205. Further, the control program includes a timer program which is used to measure a lapse of time after each ejection electrode is driven as will be described later. Furthermore, the processor 202 instructs the voltage controller 201 to apply a predetermined voltage $V_D$ to the electrophoresis electrode 107 after power-on.

First Embodiment

Figure 3A:
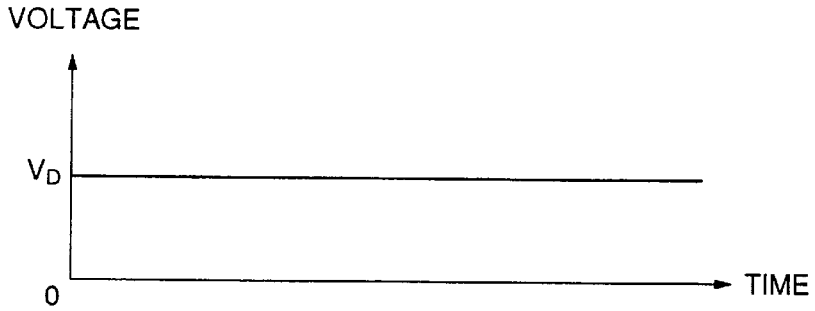
FIG. 3A is a waveform diagram showing a voltage applied to an electrophoresis electrode of the electrostatic inkjet recording head according to a first embodiment of the present invention.

Referring to FIG. 3A, when powered on, the processor 202 instructs the voltage controller 201 to apply the predetermined voltage $V_D$ to the electrophoresis electrode 107, causing an electric field to be generated in the ink chamber. The electric field moves the particulate matter such as toner particles toward the front end of the ejection electrodes 101 due to the electrophoresis phenomenon and then the meniscuses 301 are formed at the front ends of the ejection electrodes 101, respectively (see FIG. 2).

Figure 3B:
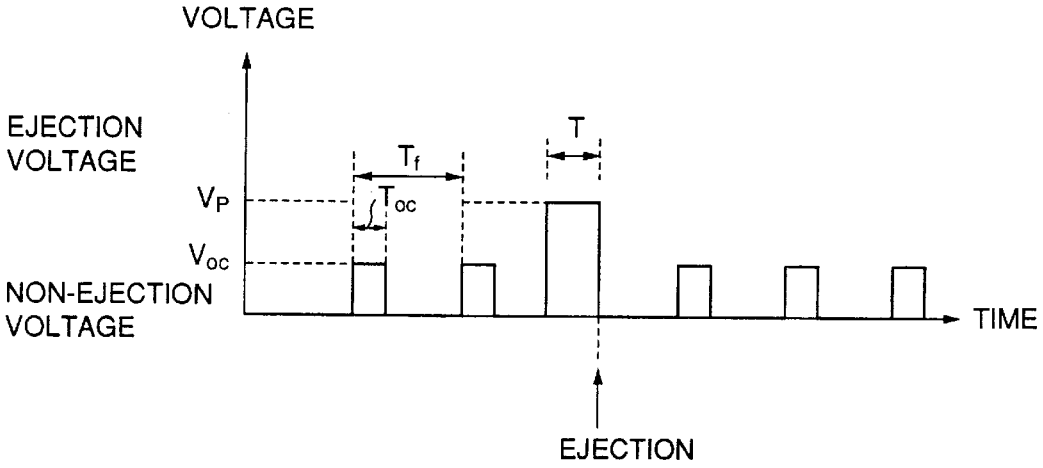
FIG. 3B is a waveform diagram showing voltages applied to ejection electrodes of the electrostatic inkjet recording head according to the first embodiment.

As shown in FIG. 3B, according to the print data received from the computer 206, the processor 202 instructs the voltage controller 201 to output the control signals $V_1$–$V_N$ to the ejection electrodes 101, respectively. When an ejection electrode (hereinafter, denoted by $E_i$) does not eject the particulate matter, pulses of a non-ejection voltage $V_{OC}$, are applied to the ejection electrode $E_i$ in a predetermined period of Tf with a pulse width of $T_{OC}$. The non-ejection voltage $V_{OC}$, the period Tf and the pulse width $T_{OC}$ are selected such that no ejection occurs. When the ejection electrode $E_i$ ejects the particulate matter, an ejection pulse of an ejection voltage $V_P$ is applied to the ejection electrode $E_i$ instead of the non-ejection pulses. The ejection voltage $V_P$ of the ejection pulse is higher than the non-ejection voltage $V_{OC}$ and the pulse width T is wider than $T_{OC}$.

Since the non-ejection pulse voltage $V_{OC}$ is applied to the ejection electrode $E_i$ in the period of Tf during the non-ejection state, the particulate matter is periodically moved to the front end of the ejection electrode $E_i$. Therefore, the meniscus 301 of the ejection electrode $E_i$ is prevented from withdrawing from the front end thereof. In such a state, when the ejection pulse voltage $V_P$ is applied, the particulate matter is instantly jetted with reliability even when the time interval between ejection voltage pulses is long.

Second Embodiment

As described before, the processor 202 uses the timer program stored in the ROM 203 to measure a lapse of time after each ejection electrode is driven. In this embodiment, the timer program can provide a timer corresponding to each ejection electrode and the timer is set to a time period of $S_1$. The time period $S_1$ is set so as to prevent the meniscus 301 of the ejection electrode $E_i$ from withdrawing from the front end thereof.

Figure 4A:
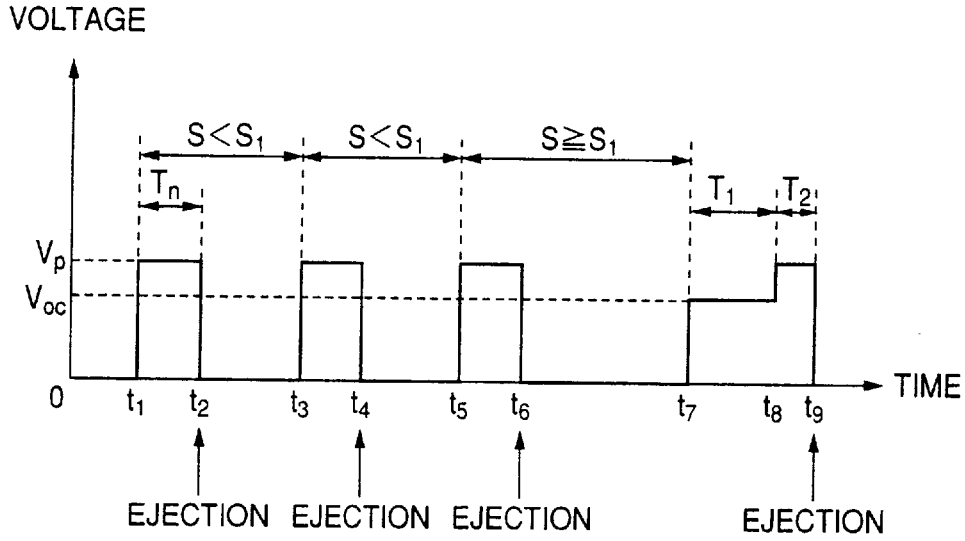
FIG. 4A is a waveform diagram showing voltages applied to the ejection electrodes of the electrostatic inkjet recording head according to a second embodiment of the present invention.

As shown in FIG. 4A, when the ejection electrode $E_i$ ejects the particulate matter, an ejection pulse of the ejection voltage $V_P$ and a pulse width Tn is applied to the ejection electrode $E_i$. For example, at a time instant $t_1$, the ejection pulse rises to the ejection voltage $V_P$ and, at a time instant $t_2$when the ejection pulse falls to zero voltages, the ejection electrode $E_i$ ejects the particulate matter. The timer is reset at the time instant $t_1$ and starts measuring a lapse of time S. When the subsequent ejection pulse rises until the timer reaches the preset time period $S_1$, the timer is reset at the time instant $t_1$ and restarts measuring a lapse of time S.

At the time $t_7$when the timer exceeds the preset time period $S_1$, the processor 202 instructs the voltage controller 201 to apply the non-ejection voltage $V_{OC}$ to the ejection electrode $E_i$ for a time period T1 before applying the ejection voltage $V_P$. The time period T1 is longer than the ejection pulse width Tn. After the non-ejection voltage $V_{OC}$ is applied to the ejection electrode $E_i$ for the time period T1, the ejection voltage pulse with a pulse width of T2 is applied to the ejection electrode $E_i$, causing the ejection to occur. The pulse width T2 is shorter than the ejection pulse width Tn. Since the non-ejection voltage $V_{OC}$ is applied to the ejection electrode $E_i$ before the ejection voltage $V_P$ is applied, the particulate matter is instantly jetted with reliability even when the time interval between ejection voltage pulses is long.

Figure 4B:
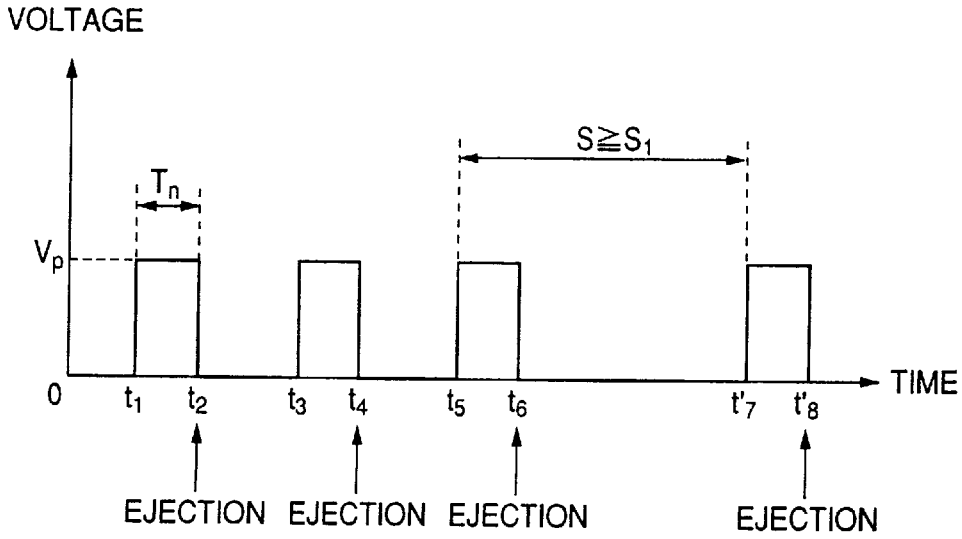
FIG.4B PRIOR ART
FIG. 4B is a waveform diagram showing voltages applied to ejection electrodes of a conventional electrostatic inkjet recording head.

Referring to FIG. 4B, according to the prior art, the ejection voltage pulse is applied to the ejection electrode $E_i$ even when the time interval between ejection voltage pulses is long. Since the meniscus 301 has withdrawn from the front end of the ejection electrode $E_i$, there are possibilities that the particulate matter cannot be jetted.

Figure 5:
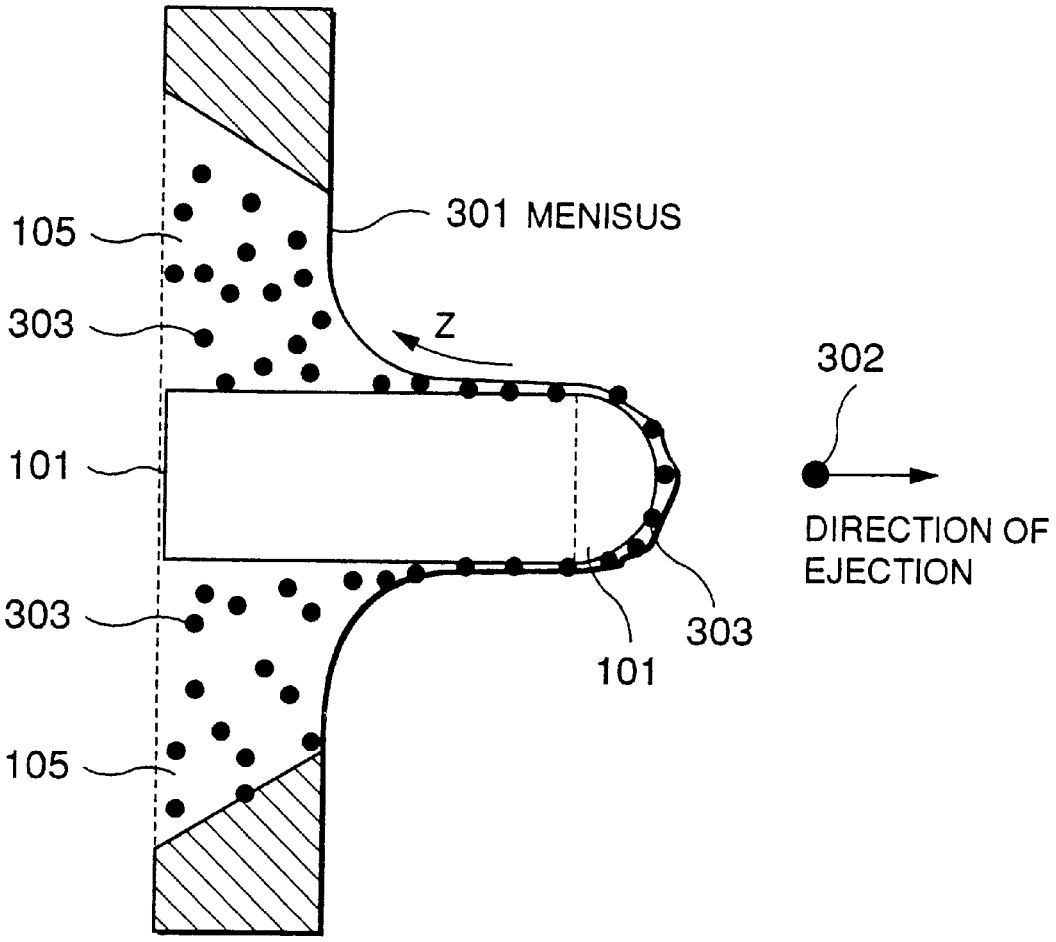
FIG. 5 is an enlarged part-plan view-of an ink nozzle of the electrostatic inkjet recording head for explanation of advantages of the present invention.

According to the first and second embodiments as described above, as shown in FIG. 5, the particulate matter 303 is concentrated onto the front end of the ejection electrode and then the ejection voltage $V_P$ is applied thereto. Therefore, the particulate matter 302 is instantly jetted with reliability even when the time interval between ejection voltage pulses is long.

Figure 6:
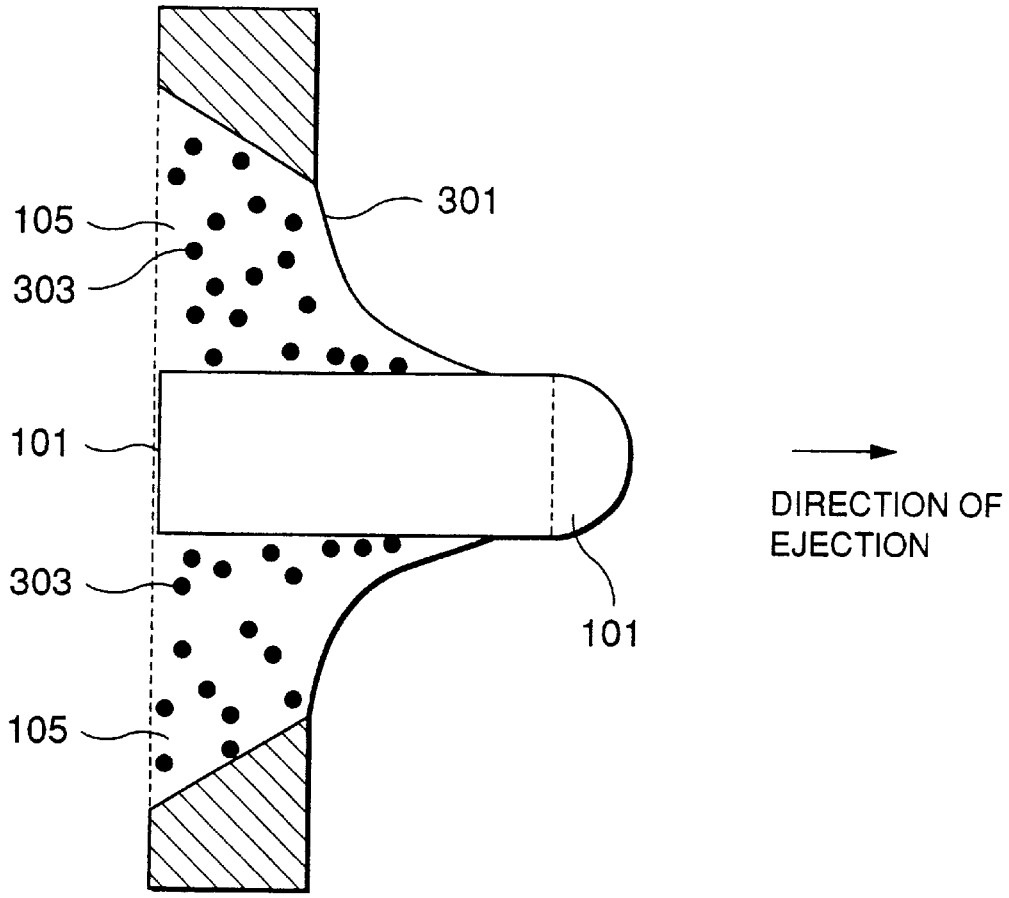
FIG.6 PRIOR ART
FIG. 6 is an enlarged part-plan view of an ink nozzle of the conventional electrostatic inkjet recording head.

Contrarily, according to the prior art as shown in FIG. 6, in cases where the time interval between voltage pulses is long, the particulate matter 303 withdraws from the front end of the ejection electrode due to the surface tension of the ink liquid. Therefore, the particulate matter 303 cannot be ejected instantly, which may cause no ejection.

Third Embodiment

When an ejection electrode is driven and the adjacent ejection electrodes are not driven, an electric field is generated between the driven ejection electrode and the adjacent ejection electrodes. The electric field generated between them causes the particulate matter in the ink to drift away from the driven ejection electrode. To prevent such a drift, the voltage controller 201 controls the adjacent ejection electrodes such that these ejection electrodes are at approximately the same potential. The details will be described hereinafter.

Figure 7:
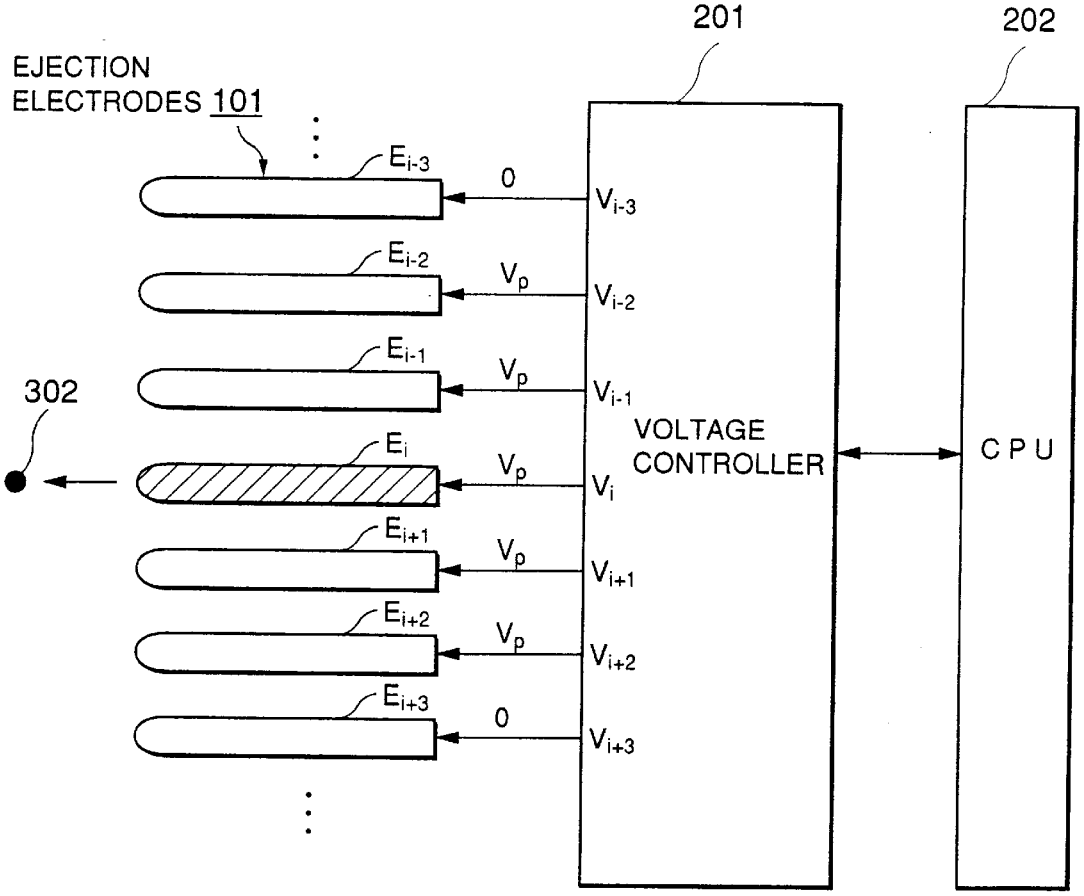
FIG. 7 is a block diagram showing a part of the circuit configuration which drives the electrostatic inkjet recording head according to a third embodiment of the present invention.

Referring to FIG. 7, assuming that the particulate matter 302 is jetted by an ejection electrode $E_i$, the voltage controller 201 applies the ejection voltage $V_P$ to the ejection electrode $E_i$ and its adjacent ejection electrodes $E_{1-1}$, $E_{i-2}$, $E_{i+1}$ and $E_{i+2}$. In this embodiment, however, these applied ejection voltage pulses are different in pulse width between the ejection electrode $E_i$ and the adjacent ejection electrodes $E_{i-1}$, $E_{i-2}$, $E_{i+1}$ and $E_{i+2}$.

Figure 8:
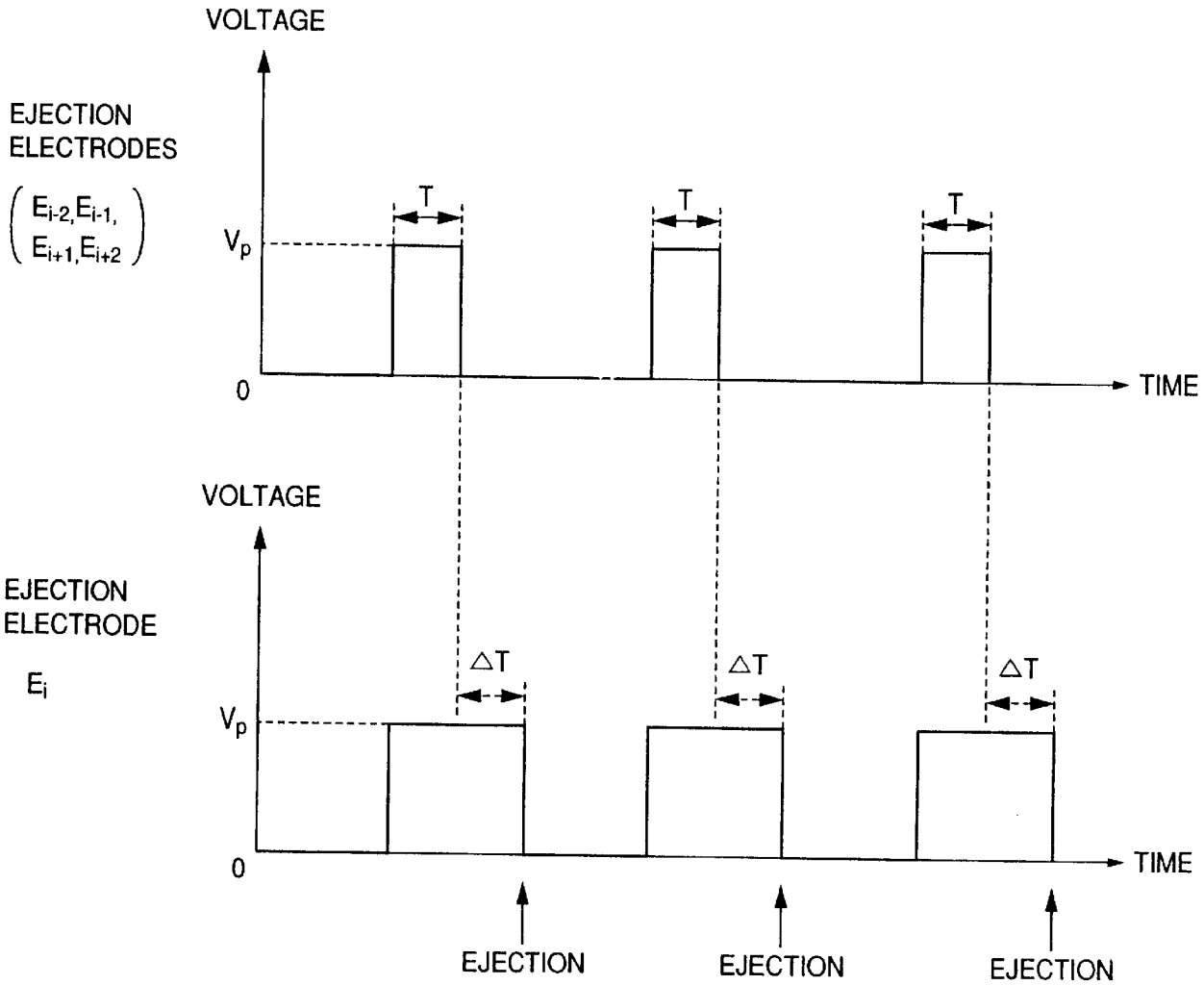
FIG. 8 is a waveform diagram showing voltages applied to ejection electrodes of the electrostatic inkjet recording head according to the third embodiment.

Referring to FIG. 8, the ejection voltage pulse of a pulse width T is applied to the adjacent ejection electrodes $E_{i-1}$, $E_{i-2}$, $E_{i+1}$ and $E_{i+2}$ while the ejection voltage pulse of a pulse width T+ΔT is applied to the ejection electrodes $E_i$. The pulse width T is determined such that no ejection occurs but the pulse width T+ΔT which is longer than the pulse width T by a time period of ΔT is determined such that ejection occurs.

Since the ejection electrode $E_i$ and the adjacent ejection electrodes $E_{i-1}$, $E_{i-2}$, $E_{i+1}$ and $E_{i+2}$ are at the same potential (ejection potential $V_P$) for the time period T, the particulate matter in the ink does not drift away from the ejection electrode $E_i$ to the adjacent ejection electrodes $E_{i-1}$ and $E_{i+1}$. After a lapse of the time period T, the respective potentials of the adjacent ejection electrodes $E_{i-1}$, $E_{i-2}$, $E_{i+1}$ and $E_{i+2}$ fall to the ground level. However, the ejection electrode $E_i$ remains at the ejection potential for the time period of ΔT. Therefore, the particulate matter 302 is jetted from the ejection electrode $E_i$ toward the counter electrode 108.

Fourth Embodiment

According to a fourth embodiment, when an ejection electrode is driven, the ejection electrodes adjacent to the driven ejection electrode are floated. The details will be described hereinafter.

Figure 9:
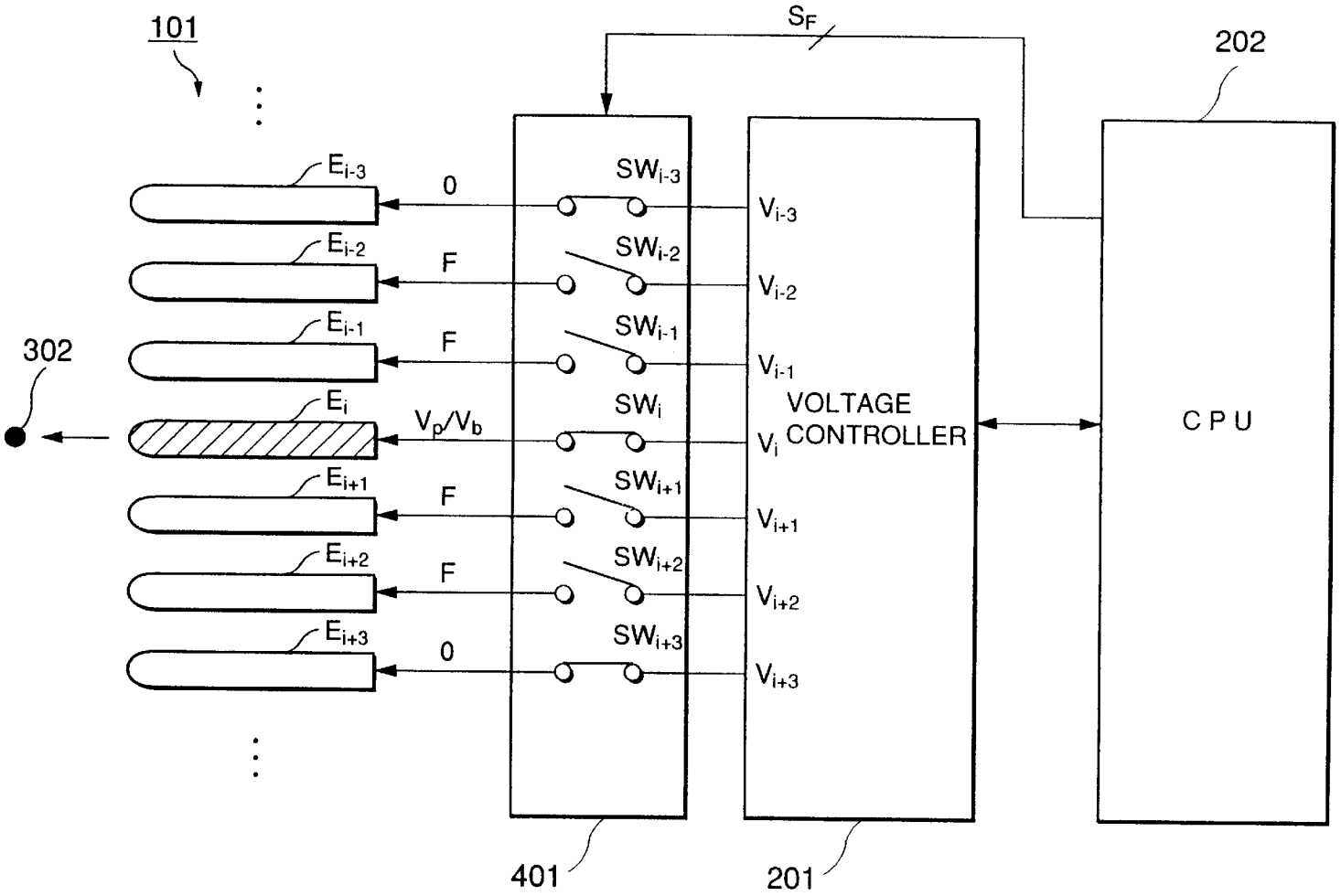
FIG. 9 is a block diagram showing a part of the circuit configuration which drives the electrostatic inkjet recording head according to a fourth embodiment of the present invention.

Referring to FIG. 9, a float switch circuit 401 is connected between the voltage controller 201 and the ejection electrodes 101. The float switch circuit 401 includes N float switches $SW_1$–$SW_N$ corresponding to the ejection electrodes 101, respectively. The float switches $SW_1$–$SW_N$ are controlled by the processor 202 through control signals $S_{F1}$–$S_{FN}$, respectively. When a float switch $SW_i$ is closed, the control voltage $V_i$ is transferred from the voltage controller 201 to the corresponding ejection electrode $E_i$. When the float switch $SW_i$ is open, the corresponding ejection electrode $E_i$ is in a floating state.

Figure 10:
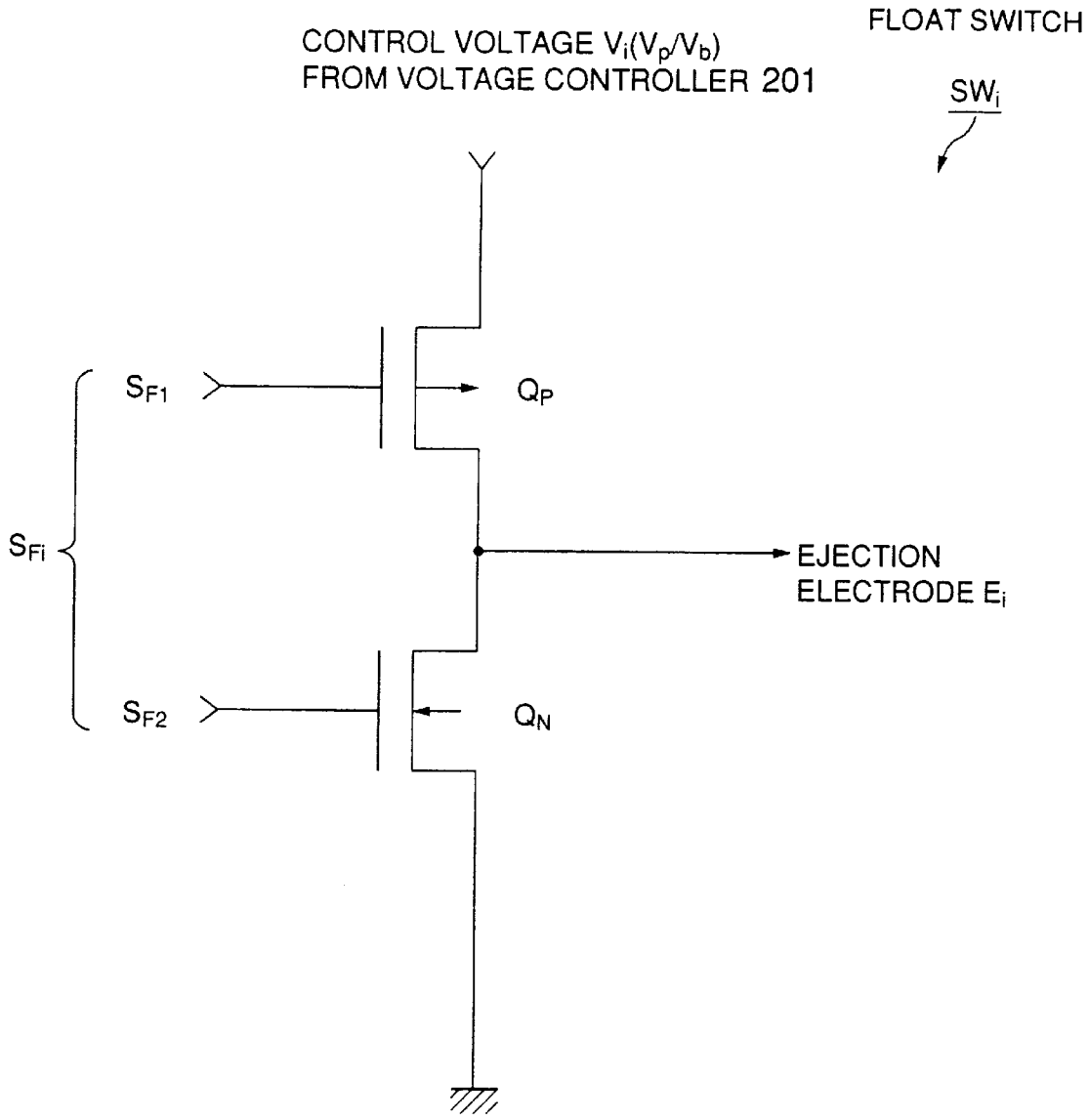
FIG. 10 is a circuit diagram showing an example of a float switch circuit in the electrostatic inkjet recording head according to the fourth embodiment.

Referring to FIG. 10, there is shown an example of the circuit of a float switch. The float switch includes a p-channel field effect transistor $Q_P$ and a n-channel field effect transistor $Q_N$ which are connected in series. The source of the transistor $Q_P$ receives the control voltage $V_i$ from the voltage controller 201 and the source of the transistor $Q_N$ is grounded. The drains of the transistors $Q_P$ and $Q_N$ are connected in common to the corresponding ejection electrode $E_i$. The respective gates of the transistors $Q_P$ and $Q_N$ receive control signals $S_{F1}$ and $S_{F2}$ of the control signal $S_{Fi}$ from the processor 202. When the control signals $S_{F1}$ and $SF_2$ are ON and OFF, respectively, the control voltage $V_i$ is transferred to the corresponding ejection electrode $E_i$ through the transistors $Q_P$. When the control signals $S_{F1}$ and $S_{F2}$ are OFF and ON, respectively, the corresponding ejection electrode $E_i$ is grounded through the transistor $Q_N$. And when the control signals $S_{F1}$ and $SF_2$ are both OFF, the corresponding ejection electrode $E_i$ is in the floating state because both transistors $Q_P$ and $Q_N$ are in high impedance state.

It is assumed for simplicity that only the ejection electrode $E_i$ is designated and jets the particulate matter 302 with the adjacent ejection electrodes $E_{i-1}$, $E_{1-2}$, $E_{i+1}$ and $E_{i+2}$ in the floating state. More specifically, as shown in FIG. 9, the float switch $SW_i$ is closed to transfer the control voltage $V_i$ to the corresponding ejection electrode $E_i$, the adjacent float switches $SW_{i-1}$, $SW_{i-2}$, $SW_{i+1}$ and $SW_{i+2}$ are open, and the other float switches are closed to ground the corresponding ejection electrodes.

Figure 11:
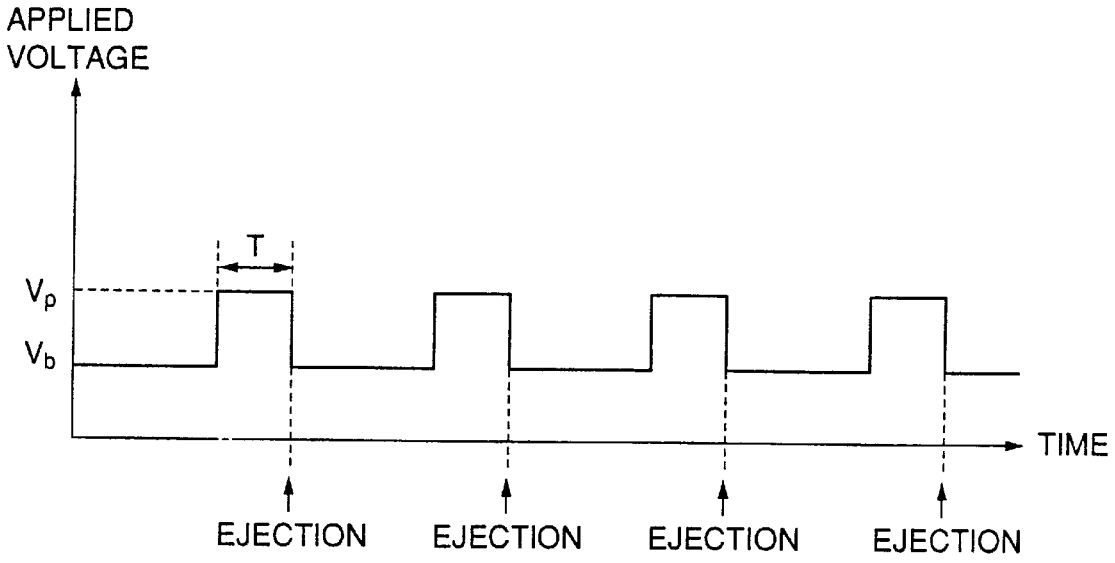
FIG. 11 is a waveform diagram showing voltages applied to ejection electrodes of the electrostatic inkjet recording head according to the fourth embodiment.

Referring to FIG. 11, an ejection pulse biased by the bias voltage Vb is applied to the ejection electrode $E_i$ according to the received print data. The ejection pulse has the ejection voltage $V_P$ and the pulse width T. Since the bias voltage Vb is applied during the interval of the ejection pulses, when the ejection voltage $V_P$ is applied thereto, abrupt drift of the particulate matter 302 is prevented and instant ejection is achieved with reliability.

Figure 12:
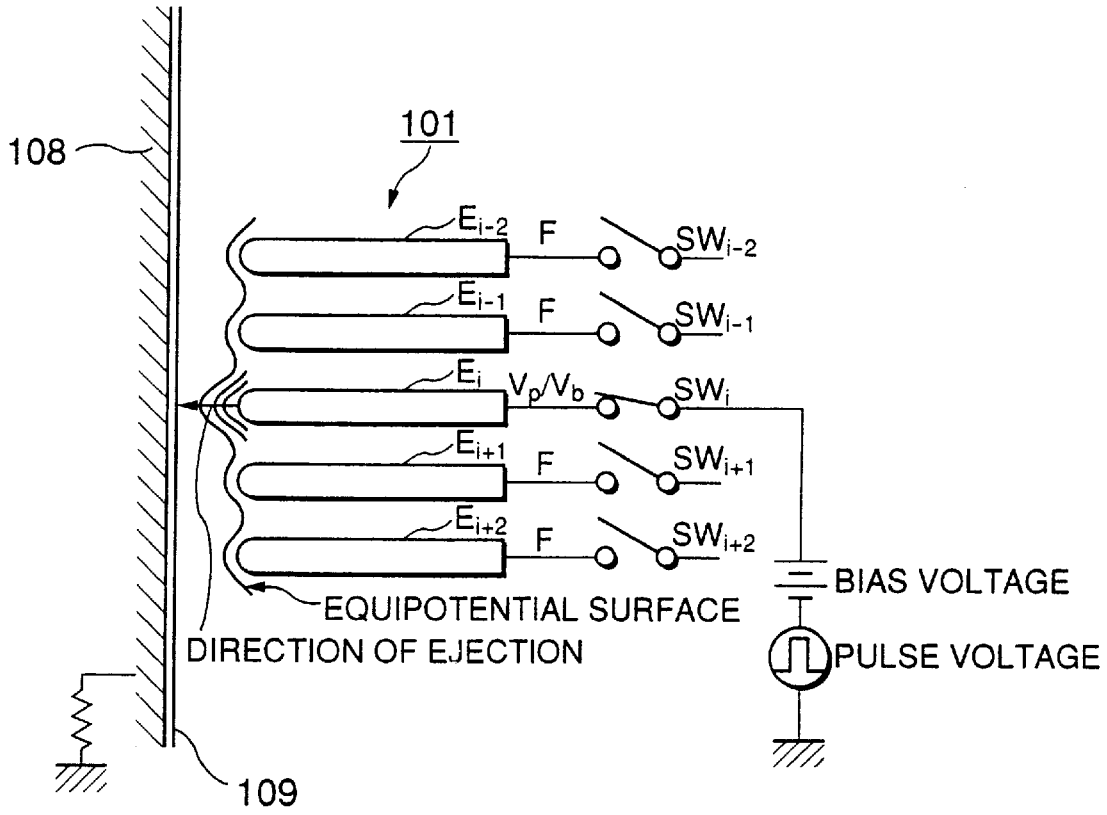
FIG. 12 is a schematic diagram showing equipotentional surfaces in an arrangement of the ejection electrodes and the counter electrode driven according to the fourth embodiment.

As shown in FIG. 12, since the adjacent ejection electrodes $E_{i-1}$, $E_{i-2}$, $E_{i+1}$ and $E_{i+2}$ are in the floating state, these adjacent ejection electrodes are at approximately the same potential as the ejection electrode $E_i$ as shown by an equipotential surface P. Therefore, the particulate matter in the ink does not drift away from the ejection electrode $E_i$. Further, the electrostatic force between the ejection electrode $E_i$ and the counter electrode 108 is generated along the direction of ejection.

Fifth Embodiment

Figure 13:
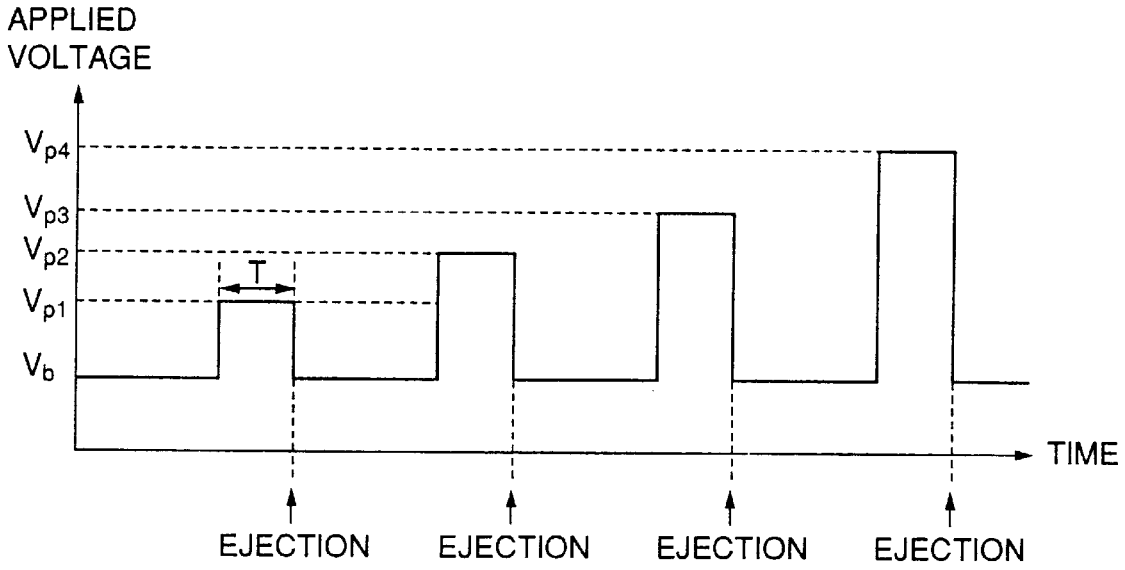
FIG. 13 is a waveform diagram showing voltages applied to ejection electrodes of the electrostatic inkjet recording head according to a fifth embodiment of the present invention.

Referring to FIG. 13, an ejection pulse biased by the bias voltage Vb is applied to the ejection electrode $E_i$ according to the received print data. The ejection pulse has the pulse width T and an ejection voltage $V_P$ which is changed according to gray levels of the print data. More specifically, the higher the ejection voltage $V_P$, the larger the amount of ejected particulate matter. For example, the amount of ejected particulate matter at the ejection voltage $V_{P4}$ is greater than at the ejection voltage $V_{P1}$. Therefore, by controlling the ejection voltage, a plurality of levels of halftone are produced on the recording medium 109.

Since the bias voltage Vb is applied during the interval of the ejection pulses, when the ejection voltage $V_P$ is applied thereto, abrupt drift of the particulate matter 302 is prevented and instant ejection is achieved with reliability.

While the invention has been described with reference to specific embodiments thereof, it will be appreciated by those skilled in the art that numerous variations, modifications, and any combination of the first to fifth embodiments are possible, and accordingly, all such variations, modifications, and combinations are to be regarded as being within the scope of the invention.

What is claimed is:

1. A control method for a plurality of ejection electrodes provided in an electrostatic inkjet device, comprising the steps of:

a) changing a potential of an ejection electrode to an ejection level for a first time period when the ejection electrode Is designated as an ejection dot; and b) changing the potential of the ejection electrode within a predetermined level different from a ground level such that ejection does not occur at the ejection electrode when the ejection electrode is not designated as the ejection dot.

2. The control method according to claim 1, wherein step b) is performed by changing the potential of the ejection electrode periodically to the predetermined level for a second time period.

3. The control method according to claim 1, wherein step b) is performed by changing the potential of the ejection electrode to the predetermined level.

4. The control method according to claim 1, wherein step b) is performed by changing the potential of the ejection electrode to the predetermined level for a second time period, and wherein step b) is performed before changing the potential of the ejection electrode to the ejection level in the step a) when the ejection electrode is subsequently designated as an ejection dot.

5. The control method according to claim 1, further comprising the step of:

c) changing the potential of the ejection electrode to the ejection level for a third time period which is shorter than the first time period, wherein step b) is performed by changing the potential of the ejection electrode to the predetermined level for a second time period, and wherein step c) is performed upon the end of the second time period.

6. The control method according to claim 1, further comprising the steps of:

c) measuring a lapse of time after changing the potential of the ejection electrode to the ejection level in the step a), and wherein step b) is performed by changing the potential of the ejection electrode to the predetermined level for a second time period when the lapse of time exceeds a predetermined time period.

7. The control method according to claim 6, further comprising the step of:

d) changing the potential of the ejection electrode to the ejection level for a third time period which is shorter than the first time period, wherein step d) is performed upon the end of the second time period when the ejection electrode is subsequently designated as an ejection dot.

8. The control method according to claim 1, wherein step b) includes a substep of changing the potential of the ejection electrode to the ejection level for a second time period shorter than the first time period when another ejection electrode in proximity to the ejection electrode is designated as the ejection dot.

9. The control method according to claim 8, further comprising the step of:

c) designating a plurality of ejection electrodes in proximity to the ejection electrode which is designated as the ejection dot, and wherein step b) further includes a substep of changing the potential of each of the designated plurality of ejection electrodes to the ejection level for the second time period shorter than the first time period.

10. The control method according to claim 9, wherein, in step b), the substep of changing the potential of each of the designated plurality of ejection electrodes to the ejection level is performed by applying an ejection voltage to the designated plurality of ejection electrodes for the second time period.

11. The control method according to claim 8, wherein step b) further includes a substep of changing the potential of the ejection electrode to the predetermined level which is lower than the ejection level when the ejection electrode is not in proximity to an ejection electrode designated as the ejection dot.

12. The control method according to claim 8, wherein, in step b), the substep of changing the potential of the ejection electrode to the ejection level is performed by applying an ejection voltage to the ejection electrode for the second time period.

13. The control method according to claim 1, wherein step b) includes a substep of chancing the potential of the ejection electrode to a floating level which is greater than the ground level and lower than the ejection level for the first time period when another ejection electrode in proximity to the ejection electrode is designated as the ejection dot.

14. The control method according to claim 13, further comprising the step of:

c) designating a plurality of ejection electrodes in proximity to the ejection electrode which is designated as the ejection dot, and wherein step b) further includes a substep of floating the designated plurality of ejection electrodes for the first time period.

15. The control method according to claim 14, wherein, in step b), the substep of floating the designated plurality of ejection electrodes is performed by electrically disconnecting the ejection electrodes from other circuits for the first time period.

16. The control method according to claim 13, wherein step b) further includes a substep of changing the potential of the ejection electrode to the predetermined level when the ejection electrode is not in proximity to an ejection electrode designated as the ejection dot.

17. The control method according to claim 1, wherein step a) comprises changing the potential of the ejection electrode to an ejection level which is variable according to a level of halftone.

18. A control apparatus for a plurality of ejection electrodes provided in an electrostatic inkjet device, comprising:

a data processor for processing paint data to produce control data for the ejection electrodes; and potential controller for controlling potentials of the ejection electrodes according to the control data received from the data processor such that a potential of an ejection electrode is changed to an ejection level for a first time period when the ejection electrode is designated as an ejection dot, and the potential of the ejection electrode is changed within a predetermined level different from a ground level such that ejection does not occur at the ejection electrode when the ejection electrode to not designated as en ejection dot.

19. The control apparatus according to claim 18, wherein the potential controller applies an ejection voltage to the ejection electrode for a first time period when the ejection electrode is designated as the ejection dot and applies a non-ejection voltage to the ejection electrode in a predetermined pattern when the ejection electrode is not designated as an ejection dot.

20. The control apparatus according to claim 19, wherein the predetermined pattern is such that the non-ejection voltage is periodically applied to the ejection electrode.

21. The control apparatus according to claims 19, wherein the predetermined pattern is such that the non-ejection voltage is applied to the ejection electrode.

22. The control apparatus according to claim 19, further comprising:

a timer for measuring a lapse of time after applying the ejection voltage to the ejection electrode, wherein the potential controller applies the non-ejection voltage to the ejection electrode for a second time period before applying the ejection voltage to the ejection electrode when the lapse of time exceeds a predetermined time period.

23. The control apparatus according to claim 22, wherein the potential controller applies the non-ejection voltage to the ejection electrode for a second time period before applying the ejection voltage to the ejection electrode for a third time period which is shorter than the first time period.

24. The control apparatus according to claim 18, wherein the data processor designates a plurality of ejection electrodes in proximity to the ejection electrode which is designated as the ejection dot, and wherein the potential controller changes the potentials of the designated plurality of ejection electrodes to the ejection level for a second time period shorter than the first time period.

25. The control apparatus according to claim 24, wherein the potential controller changes the potentials of the ejection electrodes to the ejection level by applying an ejection voltage to the designated plurality of ejection electrodes for the second time period.

26. The control apparatus according to claim 18, wherein the data processor designates a plurality of ejection electrodes in proximity to the ejection electrode which is designated as the ejection dot, and wherein the potential controller floats the designated plurality of ejection electrodes for the first time period.

27. The control apparatus according to claim 26, wherein the potential controller comprises a plurality of switches connected to each of the ejection electrodes, respectively, wherein switches connected to the designated plurality of ejection electrodes in proximity to the ejection electrode which is designated as the ejection dot are open so as to float the designated plurality of ejection electrodes.

28. An electrostatic inkjet device comprising:

a plurality of ejection electrodes arranged in a nozzle of an ink chamber containing ink including particulate matter;

a data processor for processing print data to produce control data for the ejection electrodes; and a potential controller for controlling potentials of the ejection electrodes according to the control data received from the data processor such that a potential of an ejection electrode is changed to an ejection level for a first time period when the ejection electrode is designated as an ejection dot, and the potential of the ejection electrode is changed within a predetermined level different from a ground level such that ejection does not occur at the ejection electrode when the ejection electrode is not designated as an ejection dot.

29. The electrostatic inkjet device according to claim 28, wherein the potential controller applies an ejection voltage to the ejection electrode for a first time period when the ejection electrode is designated as the ejection dot and applies a non-ejection voltage to the ejection electrode in a predetermined pattern when the ejection electrode is not designated as an ejection dot.

30. The electrostatic inkjet device according to claim 29, further comprising:

a timer for measuring a lapse of time after applying the ejection voltage to the ejection electrode, wherein the potential controller applies the non-ejection voltage to the ejection electrode for a second time period before applying the ejection voltage to the ejection electrode when the lapse of time exceeds a predetermined time period.

31. The electrostatic inkjet device according to claim 28, wherein the data processor designates a plurality of adjacent ejection electrodes in proximity to the ejection electrode which is designated as the ejection dot, and wherein the potential controller changes the potentials of the adjacent ejection electrodes to the ejection for a fourth time period shorter than the first time period.

32. The electrostatic inkjet device according to claim 28, wherein the data processor designates a plurality of adjacent ejection electrodes in proximity to the ejection electrode which is designated as the ejection dot, and wherein the potential controller floats the adjacent ejection electrodes for the first time period.

33. Tho electrostatic inkjet device according to claim 32, wherein the potential controller comprises a plurality of switches connected to each of the ejection electrodes, respectively, and wherein switches connected to the ejection electrodes in proximity to the ejection electrode which is designated as the ejection dot are open so as to float them.

34. The electrostatic inkjet device according to claim 28, wherein the ink chamber has an electrophoresis electrode therein, the electrophoresis electrode drifting the particulate matter in the ink toward the nozzle.

35. An electrostatic inkjet recording system comprising;

an inkjet head including a plurality of ejection electrodes arranged in a nozzle of an ink chamber containing ink including particulate matter;

a counter electrode for generating a potential with each of the ejection electrodes to eject ink on a recording medium placed on the counter electrode:

a data processor for processing print data to produce control data for the ejection electrodes; and a potential controller for controlling potentials of the ejection electrodes according to the control data received from the data processor such that a potential of an ejection electrode is changed to an ejection level for a first time period when the ejection electrode is designated as an ejection dot, and the potential of the ejection electrode is changed within a predetermined level different from a ground level such that ejection does not occur at the ejection electrode when the ejection electrode is not designated as an ejection dot.

* * * * *